US006811047B1

(12) United States Patent
Hicks et al.

(10) Patent No.: US 6,811,047 B1
(45) Date of Patent: Nov. 2, 2004

(54) CLOSURE WITH ENHANCED REMOVAL CAPABILITY

(75) Inventors: Marge M. Hicks, Eagle, WI (US); James W. Hammond, North Prairie, WI (US); Alan P. Hickok, Waukesha, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 30 days.

(21) Appl. No.: 10/413,104

(22) Filed: Apr. 14, 2003

(51) Int. Cl.[7] ..... B65D 41/04
(52) U.S. Cl. ..... 215/305; 215/329
(58) Field of Search ..... 215/305, 303, 215/295, 329; 220/288

(56) References Cited

U.S. PATENT DOCUMENTS 1,665,602 A * 4/1928 Netherland ..... 215/305
3,433,380 A * 3/1969 Kawchitch ..... 215/329
D291,868 S * 9/1987 Hindle ..... D9/453
D354,914 S * 1/1995 Newman ..... D9/453
5,941,404 A * 8/1999 Charrette ..... 215/305
6,253,942 B1 * 7/2001 Elias ..... 215/305

FOREIGN PATENT DOCUMENTS

GB 3001343 2/2002

* cited by examiner

*Primary Examiner*—Nathan J. Newhouse
(74) *Attorney, Agent, or Firm*—Wood, Phillips, Katz, Clark & Mortimer

(57) ABSTRACT

A closure is provided for an opening in a container having a wall around the opening and at least one thread on the wall. The closure includes (1) an attachment wall defining at least one thread for threadingly engaging the container wall thread, (2) an occlusion wall closing the attachment wall to occlude the container opening when the container is in the closed position, and (3) a continuously curving, peripheral, finger-engaging surface which defines (1) a plurality of circumferentially spaced protuberances, (2) a finger-receiving recess between adjacent protuberances, and (3) a finger-engaging rib projecting laterally from each of the protuberances.

10 Claims, 7 Drawing Sheets

CLOSURE WITH ENHANCED REMOVAL CAPABILITY

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a container closure which can be screwed on and off.

BACKGROUND OF THE INVENTION AND

TECHNICAL PROBLEMS POSED BY THE PRIOR ART

A variety of packages that include closures or lids on containers have been developed for household products, personal care products, and other products. One type of package includes a container that is internally or externally threaded around the container mouth or opening and includes a closure with a stem or skirt having mating threads for threadingly engaging the container threads.

It would be desirable to provide an improved closure for use with such packages.

Additionally, it would be advantageous if such an improved closure could incorporate a structure which could be more easily grasped by the user's fingers for opening the container by unscrewing the closure or for closing the container by screwing the closure onto the container.

It would be especially desirable to provide a closure gripping structure that would facilitate the rotation of a relatively small closure by enabling the user to generate sufficient torque for screwing and unscrewing the closure relative to the container. It would be particularly beneficial if the gripping structure would allow the user to generate sufficient torque to open a closure even when a tamper-evident, frangible connection is provided between the closure and container. It would also be especially desirable if such a gripping structure was comfortable for the user to grip.

Preferably, such a structure should provide improved engagement with the user's fingers under wet conditions so as to minimize the tendency of the finger to slip off of the closure.

Such an improved closure should preferably also facilitate the removal or installation of the closure by a child as well as by an elderly person having impaired manual dexterity or reduced strength.

It would also be beneficial if such an improved closure could also accommodate, or actually contain, optional features which provide good sealing of the closure to the container and/or which provide initial, tamper-evident frangible connections between the closure and container.

It would also be advantageous if such an improved closure could accommodate a variety of aesthetically pleasing designs adaptable for use with various containers.

It would also be beneficial if such an improved closure could readily accommodate its manufacture from a variety of different materials.

Further, it would be desirable if such an improved closure could be provided with a design that would accommodate efficient, high quality, large volume manufacturing techniques with a reduced product reject rate.

Preferably, the improved closure should also accommodate high speed manufacturing techniques that produce closures having consistent operating characteristics unit-to-unit with high reliability.

The present invention provides an improved closure which can accommodate designs having the above-discussed benefits and features.

BRIEF SUMMARY OF THE INVENTION

According to one aspect of the present invention, a closure is provided for an opening to a container that has a wall around the opening and at least one thread on the wall. The closure is especially suitable for use on a container that has a very small opening.

The closure is adapted for movement between a closed position occluding the opening and an open position spaced from the opening. The closure includes an attachment wall defining at least one thread for threadingly engaging the container wall thread. The closure also includes an occlusion wall closing said attachment wall to occlude the container opening when the closure is in the closed position. The closure further includes a continuously curving, peripheral, finger-engaging surface which defines (1) a plurality of circumferentially spaced protuberances projecting laterally in relation to the attachment wall, (2) a finger-receiving recess between two adjacent protuberances, and (3) a finger-engaging rib projecting laterally from each of the protuberances. Each protuberance has a portion that is wider than the rib where the protuberance merges smoothly into the rib.

The improved closure provides an improved peripheral surface region for being gripped by the user's fingers. The peripheral surface minimizes slippage between the user's fingers and the closure. The peripheral surface region can also be readily provided with a different color, as well as a different texture or material, than the rest of the closure.

The improved closure can also be readily designed to provide a seal within the closure for sealing against the container at the container opening.

The closure can also be initially connected to the container with a tamper-evident, frangible connection.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DETAILED DESCRIPTION

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure of this invention is described in a typical upright position, and terms such as upper, lower, horizontal, etc., are used with reference to this position. It will be understood, however, that the closure may be manufactured, stored, and used in orientations other than the one described.

Figure 4:
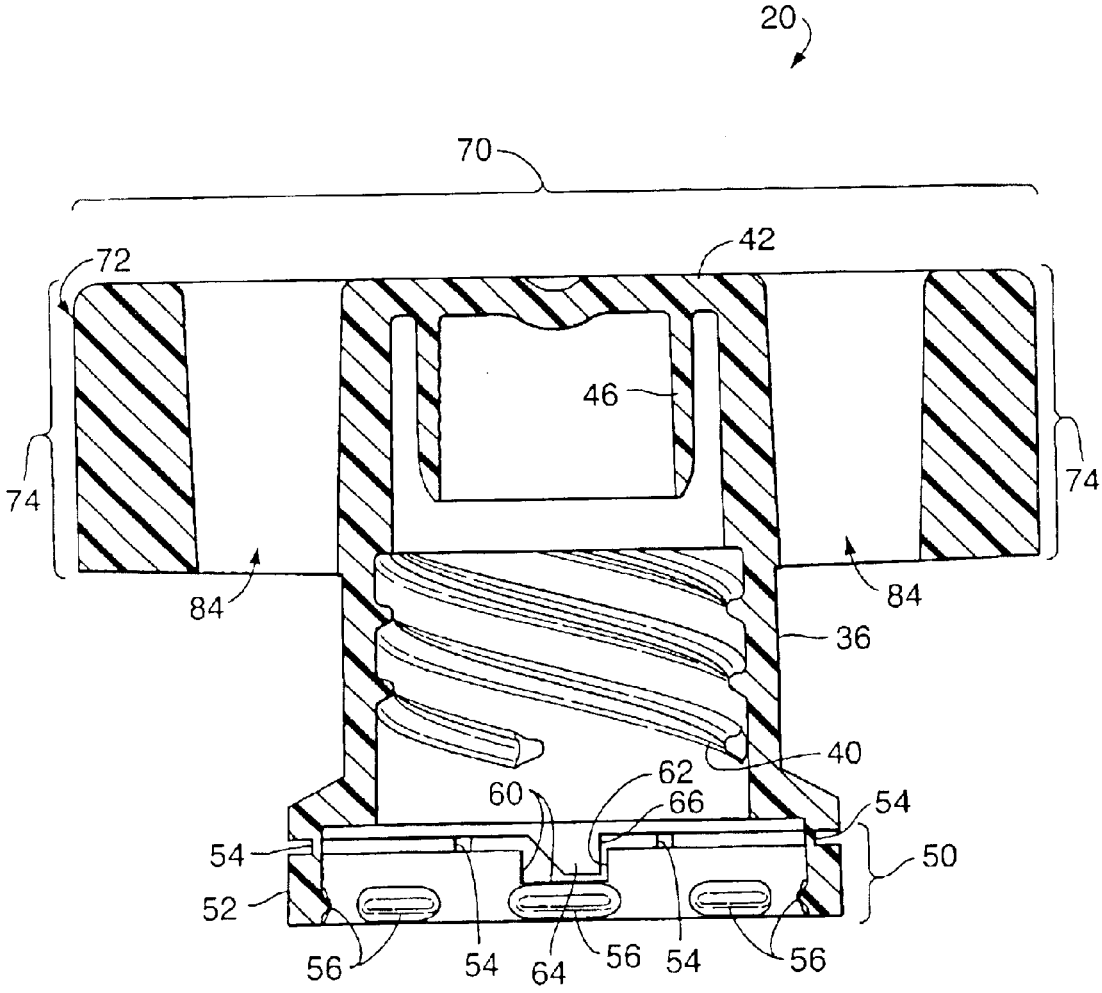
FIG. 4 is a cross-sectional view taken generally along the plane 4—4 in FIG. 2.
Figure 5:
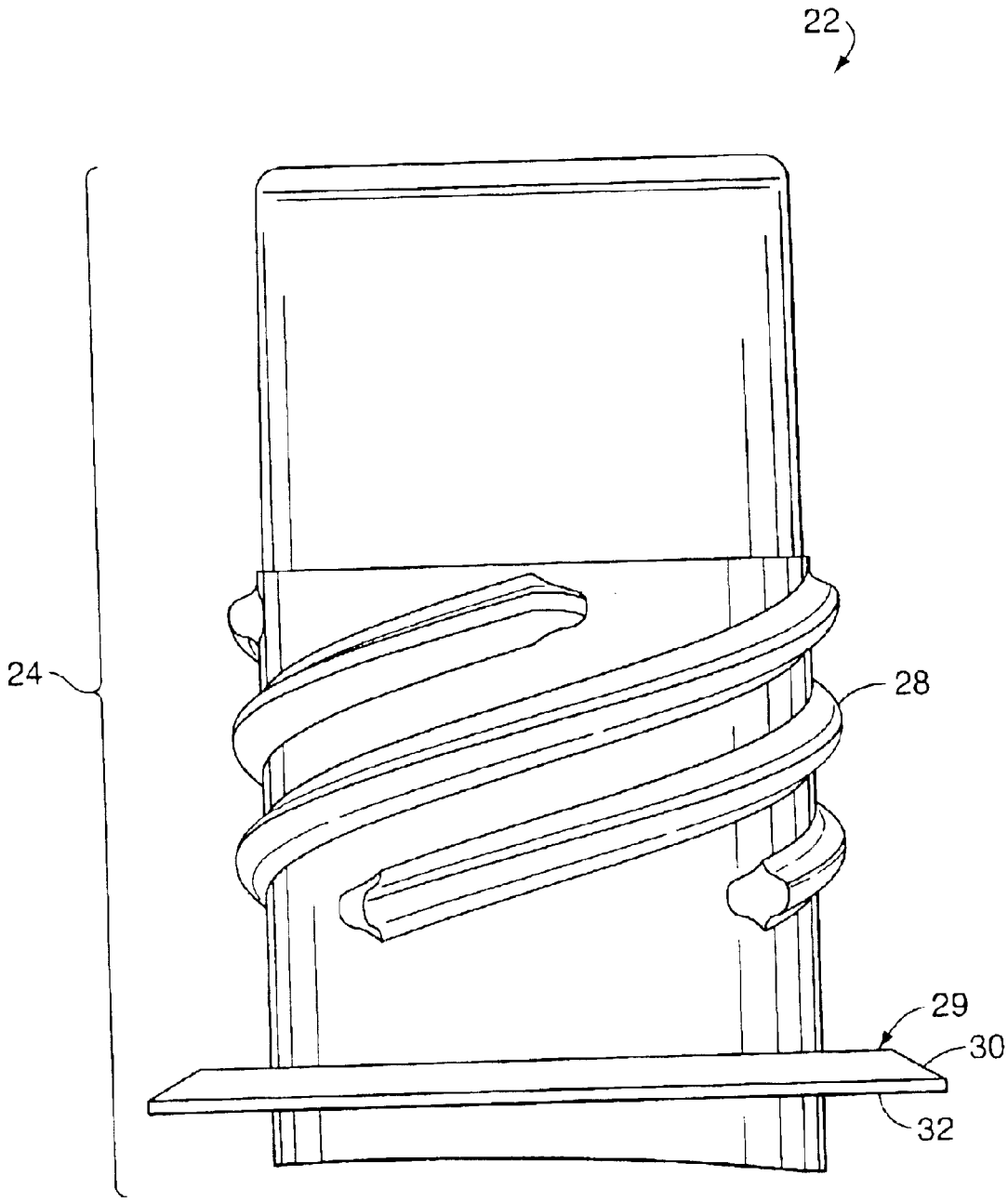
FIG. 5 is a fragmentary, side elevational view of the top portion of a container on which the closure can be installed.

A presently preferred, first embodiment of a closure of the present invention is illustrated in FIGS. 1–5 and is designated generally therein by the reference numeral 20. The closure 20 is adapted to be mounted on a container 22 (FIG. 5). The container 22 has a lower, body portion (not visible in FIG. 5) which may have any suitable configuration and has a generally annular, upper, neck portion 24 that defines (1) an upper end opening (2) an exterior, male thread or threads 28, and (3) an optional retention bead or flange 29. The flange 29 has an frustoconical, upper, peripheral edge 30 and has an annular, planar bottom surface 32.

The container body portion may have a different cross-sectional configuration than the neck portion 24. The container body portion may have a cross section that is larger or smaller than the neck portion 24. The cross-sectional shape and size of the container body portion may also be generally the same as the cross-sectional shape and size, respectively, of the neck portion 24 so that the neck portion 24 and body portion are not distinguishable from each other except for the thread 28 on the neck portion (and optional flange 29, if used).

The container 22 may be a flexible container or may be a substantially rigid container. So long as the container 22 has an opening and a thread form for receiving a closure in threaded engagement to occlude the opening, the detailed design and operation of the container 22 form no part of the present invention.

Figure 1:
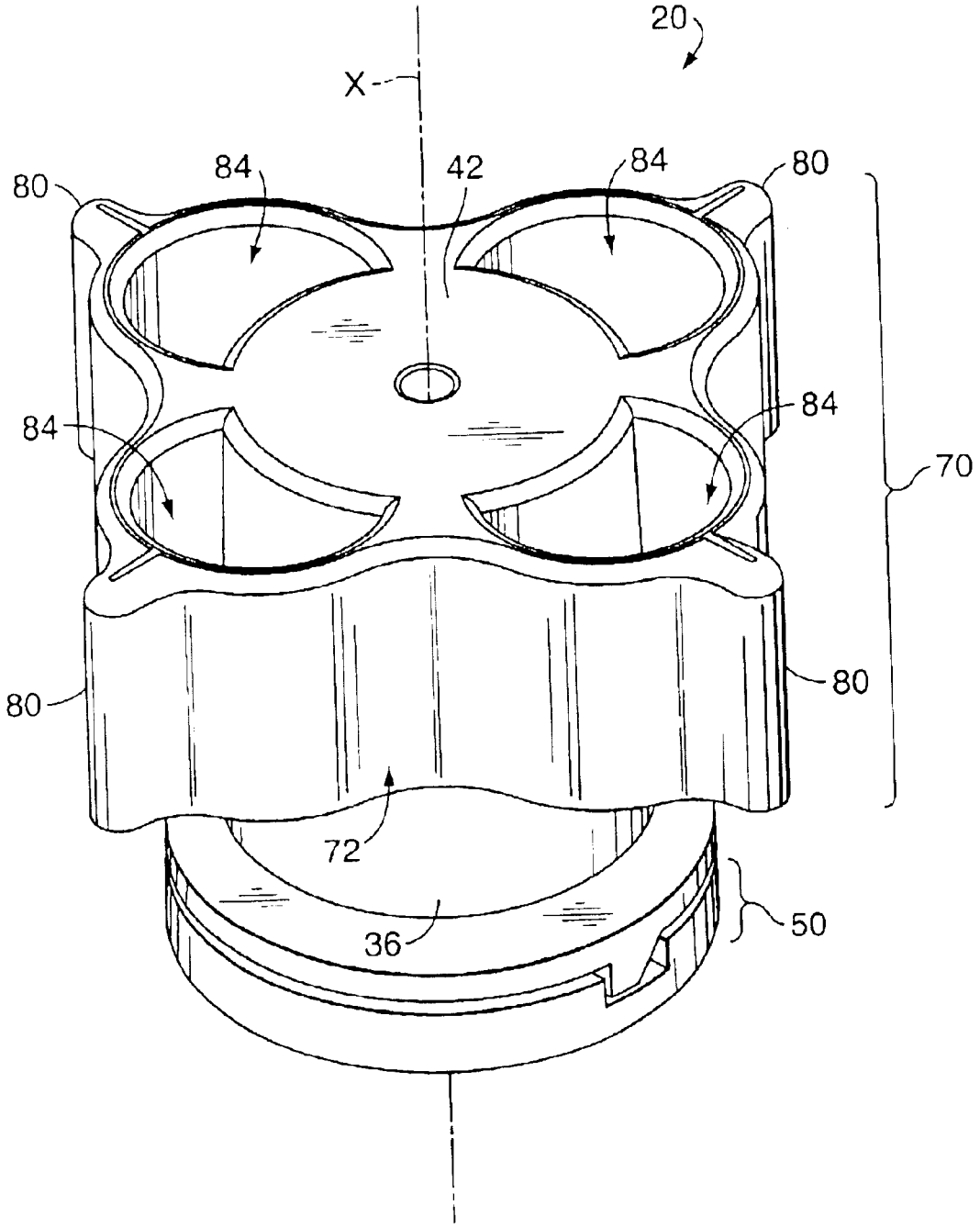
FIG. 1 is a top perspective view of a first embodiment of the closure of the present invention.

As shown in FIG. 1, the closure 20 includes an attachment wall 36 which defines at least one thread 40 (FIG. 4) for threadingly engaging a mating thread 28 (FIG. 5) on the wall of the container 22. In the preferred embodiment illustrated in FIGS. 1–5, the closure includes a set of four lead high-pitch threads 40, and the container includes a set of four lead high-pitch threads 28. Multiple high-pitch threads require less rotation of the closure to install or remove it from the container while still creating a secure connection. A greater or lesser number of threads could be employed.

The attachment wall 36 has a generally annular configuration, and the wall depends from a generally disk-like top end wall 42 (FIGS. 1 and 4) which may be characterized as "an occlusion wall" for closing the top of the attachment wall 36 to occlude the container opening when the closure 20 is in the closed position on the container.

As can be seen in FIG. 4, an annular plug seal 46 depends downwardly from the occlusion wall or end wall 42 within the attachment wall 36. The plug seal 46 is adapted to be received in the container opening and create a sealing engagement with the container wall that defines the container opening. Other suitable seal structures could be employed, such as a crab's claw-type seal (not illustrated). In some applications, it may not be necessary to provide any particular type of fluid-tight seal per se. The use of a seal, or the particular seal structure per se, forms no part of the present invention.

An optional, frangible, tamper-evident structure 50 (FIGS. 1 and 4) may be provided by on the bottom of the closure 20. A particular type of tamper-evident structure is illustrated in FIGS. 1 and 4, but other types of tamper-evident structures may be employed. Alternatively, the closure 20 need not have any type of tamper evident structure. The particular tamper-evident structure 50 illustrated in FIGS. 1 and 4 includes a retention ring 52 attached with unitary molded frangible bridges 54 (FIG. 4) to the bottom end of the closure attachment wall 36. On the inside of the retention ring 52 are a plurality of circumferentially spaced-apart bead segments 56 which are adapted to project inwardly beneath the container neck flange bottom surface 32 (FIG. 5) when the closure 20 is initially installed on the container 22. As the closure 20 is initially installed, typically by an automatic capping machine, the bead segments 56 ride down the container neck flange frustoconical surface 30 and cause the ring 52 to expand radially outwardly temporarily and elastically until the bead segments 56 are move downwardly far enough to clear the lower edge of the flange 29 and then snap radially inwardly beneath the flange surface 32.

To assist in initially installing the closure on the container 22, the ring 52 includes an upwardly open recess 60 having a leading engagement wall 62. The bottom edge of the closure attachment wall 36 includes a downwardly depending drive tab 64 having a leading driving wall 66 for engaging the ring recess engagement wall 62 during the threading-on process of installing the closure 20 on the container 22. Because of frictional resistance between the ring bead segments 56 and the flange 30 during installation, there maybe a tendency for the frangible bridges 54 to be subjected to stress as the closure attachment wall 36 is rotated by the capping machine and as the torque is transmitted through the bridges 54 to the ring 52. This could tend to cause undue deformation or failure of one or more of the frangible bridges 54 if the rotational displacement between the closure attachment 36 and the ring 52 is excessive. Accordingly, the provision of the tab 64 within the recess 60 permits only a small amount of relative rotational displacement between the two portions of the closure 20 before the tab driving wall 66 engages the ring wall 62. At that point, the ring 52 is driven directly by the tab 64 which can withstand the torque, thus limiting the relative rotational displacement between the ring 52 and wall 36 to a small amount which is readily accommodated or tolerated by the frangible bridges without rupturing the frangible bridges 54.

When the closure 20 is initially unscrewed from the container by the user for the first time, the retention ring 52 remains held below the container flange 29 while the closure attachment wall 36 moves upwardly so as to rupture the frangible bridges 54 and separate completely from the ring 52 which remains below the container flange 29 to provide evidence that the closure 20 has been unscrewed at least an amount sufficient to rupture the bridges 54.

Figure 2:
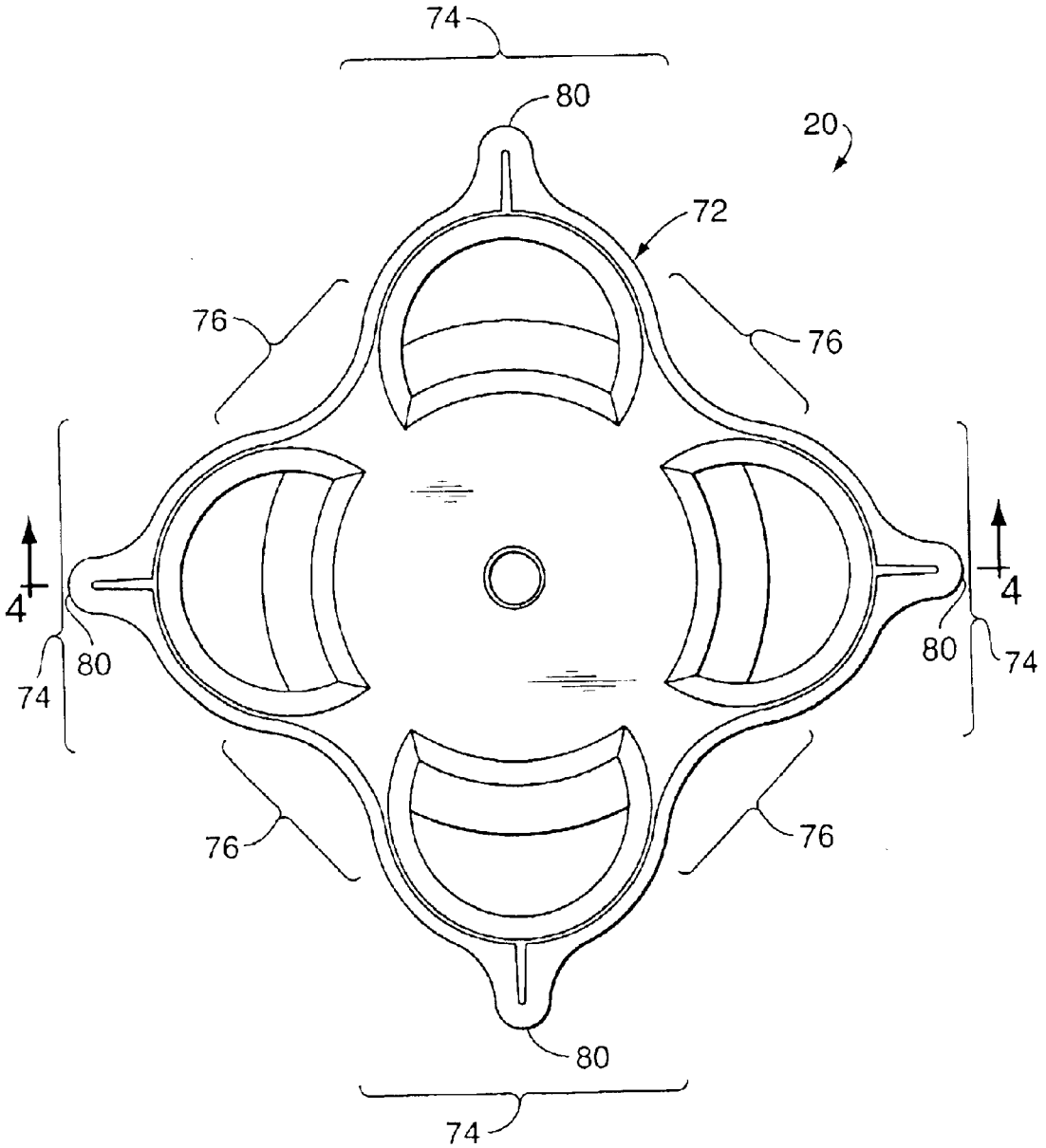
FIG. 2 is a top plan view of the first embodiment of the closure.
Figure 3:
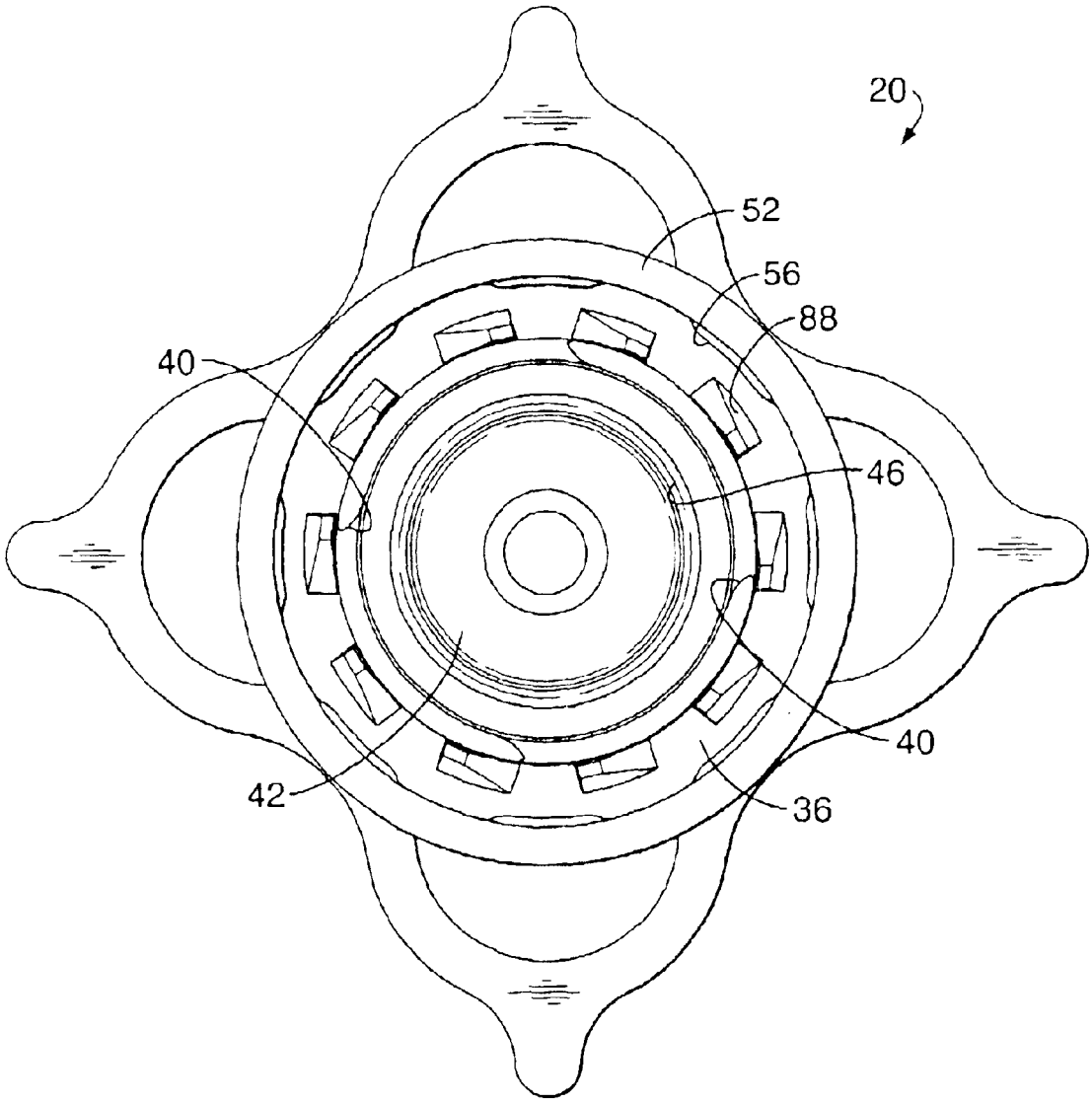
FIG. 3 is a bottom plan view of the first embodiment of the closure.

A user can readily unscrew, or screw on, the closure 20 by using a novel gripping structure 70 (FIG. 4). The gripping structure 70 includes a continuously curving, peripheral, finger-engaging surface 72 (FIG. 1). The finger-engaging surface 72 includes a plurality of circumferentially spaced protuberances 74 (FIG. 2). The protuberances 74 project laterally in relation to the attachment wall 36. A finger-receiving recess 76 (FIG. 2) is defined between each pair of two adjacent protuberances 74. The recesses 76 are adapted to receive a finger or thumb of the user's hand when the closure 20 is grasped or gripped by the user for rotating the closure 20 during the process of screwing the closure onto the container or unscrewing the closure from the container.

In the preferred embodiment illustrated in FIGS. 1–5, there are four protuberances 74, and there are finger-receiving recesses 76.

The peripheral, finger-engaging surface 72 also includes a finger-engaging rib 80 (FIG. 2) projecting laterally from each of the protuberances 74. Each protuberance 74 has a portion that is wider than the rib 80 projecting therefrom. Each protuberance 74 has a reduced width at the rib 80 where the protuberance 74 merges smoothly into the rib 80.

In the preferred embodiment illustrated in FIG. 2, each rib 80 has a convex distal end, and each protuberance 74 has a convex portion from which a rib 80 projects. Further, in the preferred embodiment, each finger-receiving recess 76 is defined by generally concave portion of the finger-engaging surface 72 which smoothly merges with the convex portions of the protuberances 74 on either side of the recess 76.

As can be seen in FIG. 2, each of the two sides of each rib 80 projects from one of the protuberances 74 at a location on the side of the one protuberance that can be defined by an imaginary line that is parallel to the closure rotational axis X (FIG. 1) and that is located on an inflection point of the continuously curving, peripheral finger-engaging surface 72.

Each rib 80 is adapted to be engaged by a portion of the user's finger or thumb when the user grasps the closure 20.

In the preferred embodiment illustrated in FIGS. 1–5, the protuberances 74 extend from, and surround, an upper portion of the attachment wall 36. Further, each protuberance 74 defines an internal passage 84 having an open top and an open bottom. The passages 84 are optional, and may be provided for reducing the amount of material required, for aesthetic reasons, or for other reasons.

The closure 20 may be made from any suitable material. In the preferred embodiment illustrated in FIGS. 1–5, the closure 20 is molded from a suitable thermoplastic material, such as polypropylene. To aid in extracting the closure 20 from the mold components (not illustrated), the bottom end of the closure attachment wall 36 maybe provided with unthreading apertures 88 (FIG. 3) for receiving a tool (not illustrated) to unscrew the molded closure 20 from the mold assembly.

In the preferred embodiment illustrated in FIGS. 1–5, the attachment wall thread 40 is an internal, female thread. However, if the closure 20 is intended to be received on a container having an internally threaded opening, then the closure threads would be designed to have an external, male thread form on the exterior surface of the attachment wall 36 (not illustrated).

Figure 6:
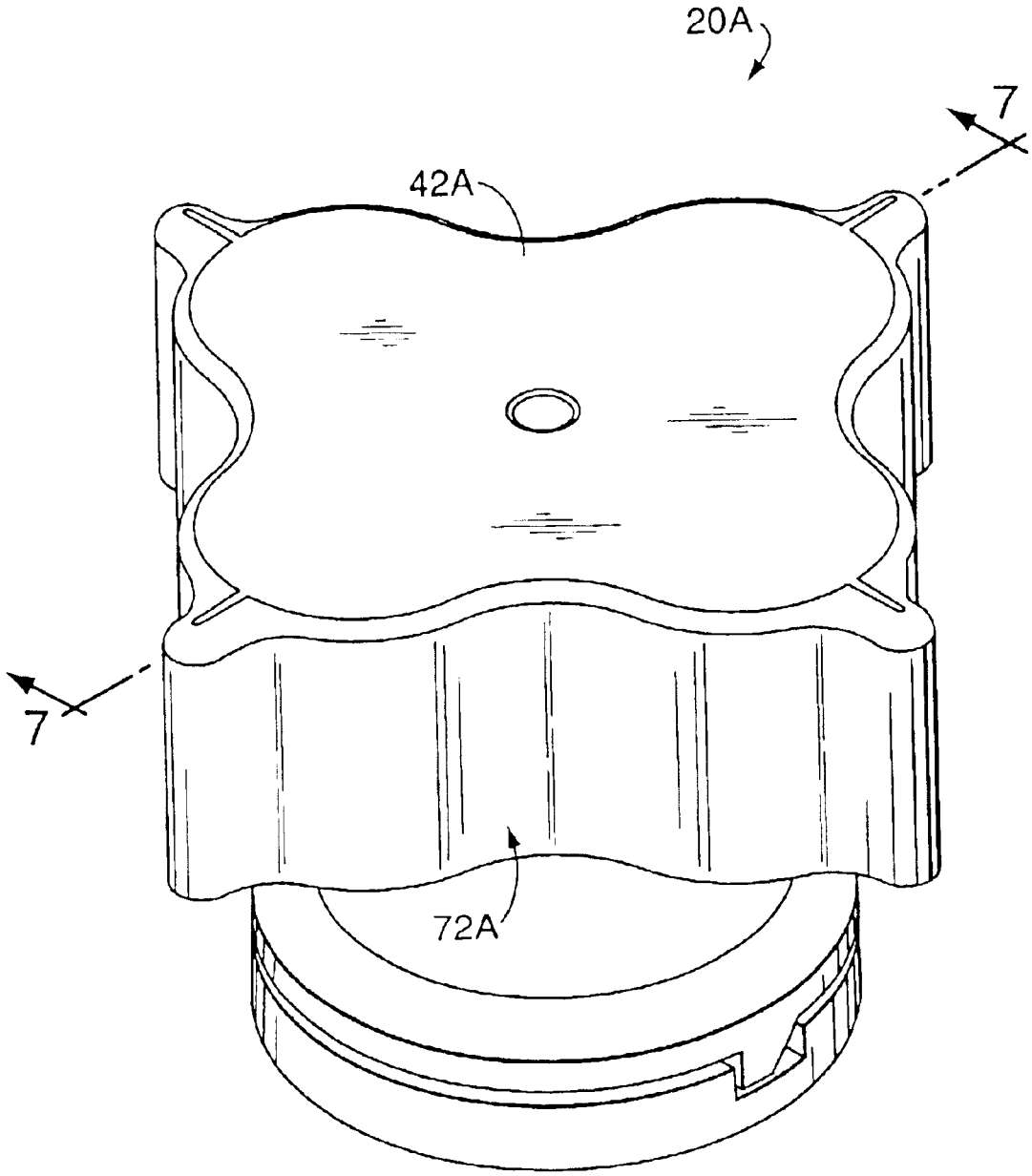
FIG. 6 is a view similar to FIG. 1, but FIG. 6 shows a second embodiment of the closure of the present invention.
Figure 7:
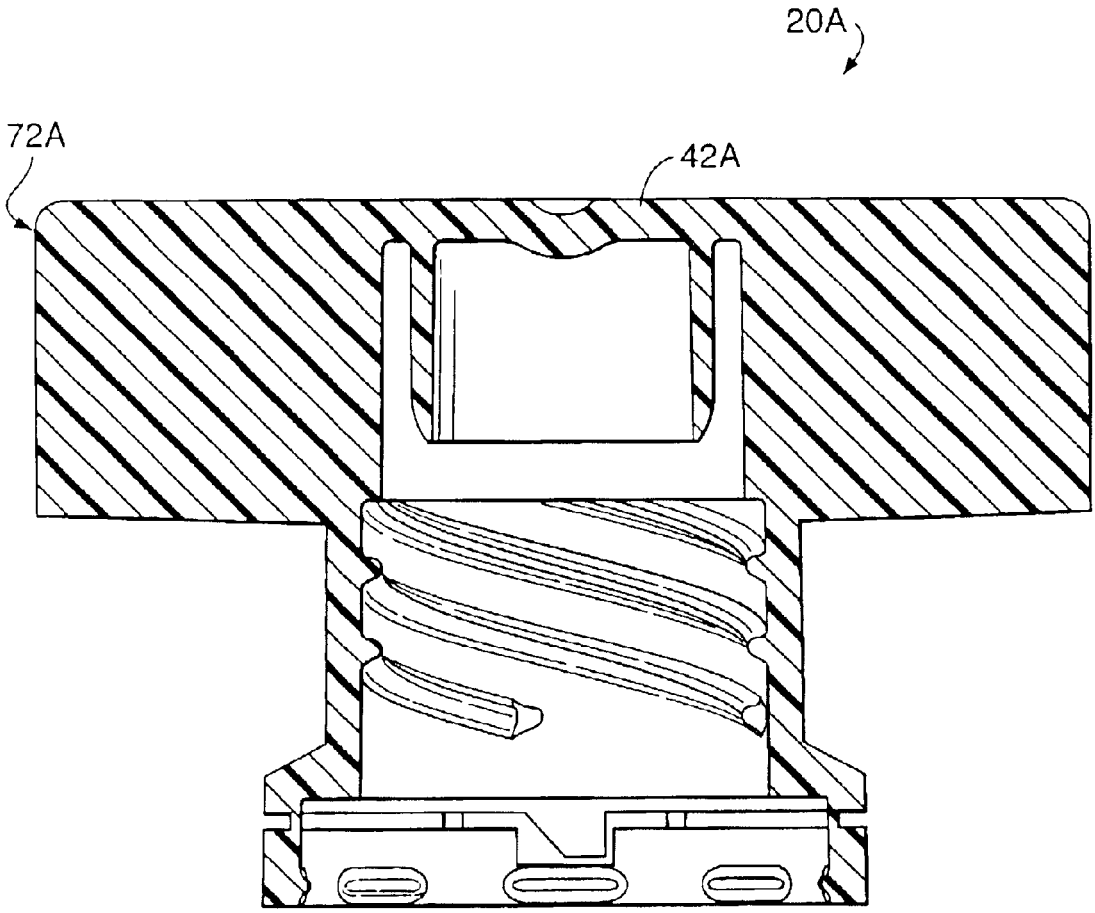
FIG. 7 is a cross-sectional view taken generally along the plane 7—7 in FIG. 6.

FIGS. 6 and 7 illustrate a second embodiment of a closure 20A in accordance with the teachings of the present invention. The second embodiment of the closure 20A provides different aesthetic design features, but retains the inventive, functional features that are in the first embodiment of the closure 20 illustrated in FIGS. 1–5 and described above.

In the alternate embodiment of the closure 20A illustrated in FIGS. 6 and 7, the closure 20A includes a continuously curving, peripheral, finger-engaging surface 72A which is identical to the finger-engaging surface 72 described above with reference to the first embodiment illustrated in FIGS. 1–5. However, the closure 20A does not have any internal passages like the passages 84 in the first embodiment closure 20 illustrated in FIG. 1. Rather, the closure 20A includes a central occlusion wall 42A which extends radially outwardly and merges with a solid, non-apertured portion of the surrounding gripping structure.

The other features of the alternate embodiment of the closure 20A are identical to the analogous features in the first embodiment of the closure 20.

If desired, in either the first embodiment of the closure 20 or the second embodiment of the closure 20A, the gripping structure may extend further downwardly toward the bottom of the closure. Alternatively, the gripping structure may have a shorter overall vertical thickness or height than what it is illustrated.

The novel gripping structure is easy to grip, and is especially suitable for use with relatively small closures which might be otherwise hard to grip and rotate for unscrewing from a container or screwing back onto a container.

The gripping structure provides a smooth surface which is comfortable to the user's hand. The protuberances and ribs are especially helpful for accommodating the elderly or children by providing a longer lever arm to generate the torque needed to unscrew the closure or to screw the closure onto the container. Sufficient torque can be generated, even by a child or by an adult with an impaired gripping function, to break a tamper-evident structure.

The combination of the finger-receiving recesses, protuberances, and ribs defined by the finger-engaging surface on the periphery of the closure accommodates the gripping of the closure with a thumb and one finger, or two fingers, or three fingers in a convenient configuration which is comfortable and which provides an effective grip for a applying sufficient torque to the closure to screw it on or off.

The novel features of the present closure invention readily accommodate manufacture of the closure, especially by molding from thermoplastic materials.

It will also be appreciated, in other alternate embodiments (not illustrated), the number of protuberances (e.g., protuberances 74 in FIG. 2) and the number of finger-engaging recesses (e.g., recesses 76 in FIG. 2) maybe increased beyond four or reduced below four.

What is claimed is:

1. A closure for an opening in a container having a wall around the opening and at least one thread on the wall, said closure being adapted for movement between a closed position occluding said opening and an open position spaced from said opening, said closure comprising:

an attachment wall defining at least one thread for threadingly engaging said container wall thread;

an occlusion wall closing said attachment wall to occlude said container opening when said closure is in said closed position; and a continuously curving, peripheral, finger-engaging surface which defines (1) a plurality of circumferentially spaced protuberances projecting laterally in relation to said attachment wall, (2) a finger-receiving recess between two adjacent protuberances, and (3) a finger-engaging rib projecting laterally from each of said protuberances, each said protuberance having a portion that is wider than said rib projecting therefrom and being of reduced width at said rib where said protuberance merges smoothly into said rib.

2. The closure in accordance with claim 1 in which each of the two sides of each of said rib projects from one of said protuberances at a location on a side of said one protuberance defined by a line that is parallel to the closure rotational axis and that is located on an inflection point of said continuously curving, peripheral, finger-engaging surface.

3. The closure in accordance with claim 1 in which there are four of said protuberances and four of said finger-receiving recesses.

4. The closure in accordance with claim 1 in which each said protuberance defines an internal passage having an open top and an open bottom.

5. The closure in accordance with claim 1 in which said attachment wall defines four multiple lead threads.

6. The closure in accordance with claim 1 in which each said rib has a convex distal end; and each said protuberance has a convex portion.

7. The closure in accordance with claim 1 in which said attachment wall is a generally annular skirt for surrounding said container wall; and each said thread on said attachment wall is an internal female thread on the inside of said skirt.

8. The closure in accordance with claim 1 in which said occlusion wall is a generally disk-like top end wall; and said attachment wall is a generally annular wall depending from said top end wall.

9. The closure in accordance with claim 8 in which said protuberances extend from, and surround, an upper portion of said attachment wall.

10. The closure in accordance with claim 1 in which said attachment wall, occlusion wall, and finger engaging surface are molded as a unitary structure from thermoplastic material.

* * * * *